US007398902B1

(12) United States Patent
Sutton

(10) Patent No.: US 7,398,902 B1
(45) Date of Patent: Jul. 15, 2008

(54) ANTI-SLIP GARMENT HANGER

(75) Inventor: Steven Sutton, Brooklyn, NY (US)

(73) Assignee: The Accessory Corp., New York, NY (US)

( * ) Notice: Subject to any disclaimer, the term of this patent is extended or adjusted under 35 U.S.C. 154(b) by 514 days.

(21) Appl. No.: 10/970,758

(22) Filed: Oct. 21, 2004

(51) Int. Cl.
*A41D 27/22* (2006.01)

(52) U.S. Cl. ..... 223/85

(58) Field of Classification Search ..... 223/85, 223/92, 95, 97; 211/113; D6/315, 317, 318, D6/328

See application file for complete search history.

(56) References Cited

U.S. PATENT DOCUMENTS

| | | | | | |
|---|---|---|---|---|---|
| 1,321,997 | A | | 11/1919 | Duberstein | |
| 1,791,021 | A | | 2/1931 | Bauer | |
| 2,132,895 | A | * | 10/1938 | Fewster | 223/92 |
| 2,912,149 | A | | 11/1959 | Stuard | 223/92 |
| 3,168,970 | A | | 2/1965 | Wilson | 223/92 |
| 3,358,891 | A | * | 12/1967 | Rowe | 223/88 |
| 4,029,239 | A | | 6/1977 | Dolan | 223/85 |
| 4,157,776 | A | | 6/1979 | Dolan | 223/92 |
| 4,586,637 | A | * | 5/1986 | Lemel | 223/92 |
| 4,606,482 | A | | 8/1986 | McHugh | 223/88 |
| 4,701,983 | A | | 10/1987 | Warmath | 24/511 |
| 4,714,183 | A | | 12/1987 | Tontarelli | 223/91 |
| D302,078 | S | | 7/1989 | De Wet | D6/319 |
| 5,113,554 | A | | 5/1992 | Gallo et al. | 24/545 |
| 5,170,916 | A | | 12/1992 | Kolton et al. | 223/92 |
| 5,183,191 | A | | 2/1993 | Garrison et al. | 223/96 |
| 5,277,345 | A | | 1/1994 | Ozaki | 223/98 |
| D358,942 | S | | 6/1995 | Blanchard et al. | D6/315 |
| D369,908 | S | | 5/1996 | Pfutzenreuter | D6/328 |
| 5,535,927 | A | | 7/1996 | Garrison | 223/92 |
| D407,909 | S | | 4/1999 | Pfutzenreuter | D6/328 |
| 5,890,634 | A | | 4/1999 | Zuckerman et al. | 223/96 |
| D409,846 | S | | 5/1999 | Blanchard | D6/318 |
| 6,070,772 | A | * | 6/2000 | Bond | 223/85 |
| 6,085,950 | A | | 7/2000 | Gouldson et al. | 223/85 |
| D440,777 | S | | 4/2001 | Giustini | D6/328 |
| 6,264,076 | B1 | * | 7/2001 | Stocchiero | 223/85 |
| D451,291 | S | | 12/2001 | Hawkins | D6/326 |
| D464,813 | S | | 10/2002 | Lin | D6/326 |
| 6,772,923 | B2 | * | 8/2004 | Olk et al. | 223/85 |
| 2004/0182891 | A1 | * | 9/2004 | Mainetti | 223/85 |
| 2005/0139625 | A1 | * | 6/2005 | Gouldson | 223/85 |

FOREIGN PATENT DOCUMENTS

| | | | |
|---|---|---|---|
| GB | 2173394 | * | 10/1986 |

* cited by examiner

*Primary Examiner*—Gary L. Welch
(74) *Attorney, Agent, or Firm*—Gordon & Jacobson, PC

(57) ABSTRACT

An anti-slip hanger is made of a molded first type of plastic which is relatively hard and slippery. The first type of plastic is molded into a hanger having a plurality of recesses, each recess being provided with at least one throughbore. Plastic inserts are molded from a second type of plastic which is relatively soft and not slippery. The inserts are sized to fit within the recesses and each insert is provided with at least one nub which is dimensioned to frictionally engage the at least one throughbore. The hangers are assembled by inserting the inserts into the recesses and pressing until the nubs engages the throughbores.

13 Claims, 3 Drawing Sheets

ANTI-SLIP GARMENT HANGER

BACKGROUND OF THE INVENTION

1. Field of the Invention

This invention relates broadly to garment hangers. More particularly, this invention relates to a garment hanger having multiple anti-slip surfaces.

2. State of the Art

Garment hangers having anti-slip surfaces are old in the art. Generally, these hangers fall into one of three categories. The first category is where the hanger is made of plastic which is molded to form ridges of some sort. An examples of this type of hanger can be found in U.S. Pat. No. 4,714,183 to Tontarelli, issued Dec. 22, 1987. These hangers are not particularly effective because the plastic which is used to form them is relatively slippery. A second category is where some material having a relatively high coefficient of friction is slipped over portions of the hanger. Examples of this type of hanger can be found in the following U.S. Pat. Nos. 3,168,970 to Wilson, issued Feb. 9, 1965, 4,586,637 to Lemel, issued May 6, 1986, 4,606,482 to McHugh, issued Aug. 19, 1986, and 5,277,345 to Ozaki, issued Jan. 11, 1994. While this type of hanger works well, its construction is complicated, requiring a significant amount of manual manipulation. The third category is where some material having a relatively high coefficient of friction is glued or welded over portions of the hanger. Examples of this type of hanger can be found in the following U.S. Pat. Nos. 1,321,997 to Duberstein, issued Nov. 18, 1919, and 5,535,927 to Garrison, issued Jul. 16, 1996. This type of hanger works well but also has a complicated construction requiring careful manual manipulation and the application of glue or operation of welding equipment.

SUMMARY OF THE INVENTION

It is therefore an object of the invention to provide an anti-slip garment hanger.

It is another object of the invention to provide an anti-slip garment hanger which is easy to manufacture.

It is a further object of the invention to provide an anti-slip garment hanger which is inexpensive to manufacture.

It is also an object of the invention to provide an anti-slip garment hanger which can be manufactured with minimal manual manipulation.

In accord with these objects, which will be discussed in detail below, the anti-slip hanger according to the invention is made of a molded first type of plastic which is relatively hard and slippery. The first type of plastic is molded into a hanger having a plurality of recesses, each recess being provided with at least one throughbore. Plastic inserts are molded from a second type of plastic which is relatively soft and not slippery. The inserts are sized to fit within the recesses and each insert is provided with at least one nub which is dimensioned to frictionally engage the at least one throughbore. The hangers are assembled by inserting the inserts into the recesses and pressing until the nubs engage the throughbores. According to the presently preferred embodiment, the inserts are relatively low profile so that they frictionally engage a garment without leaving an impression. According to one embodiment, the frictional surface of the insert is tapered so that its perimeter is substantially flush with the areas of the hanger adjacent to the recess but rises up in the center of the insert.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
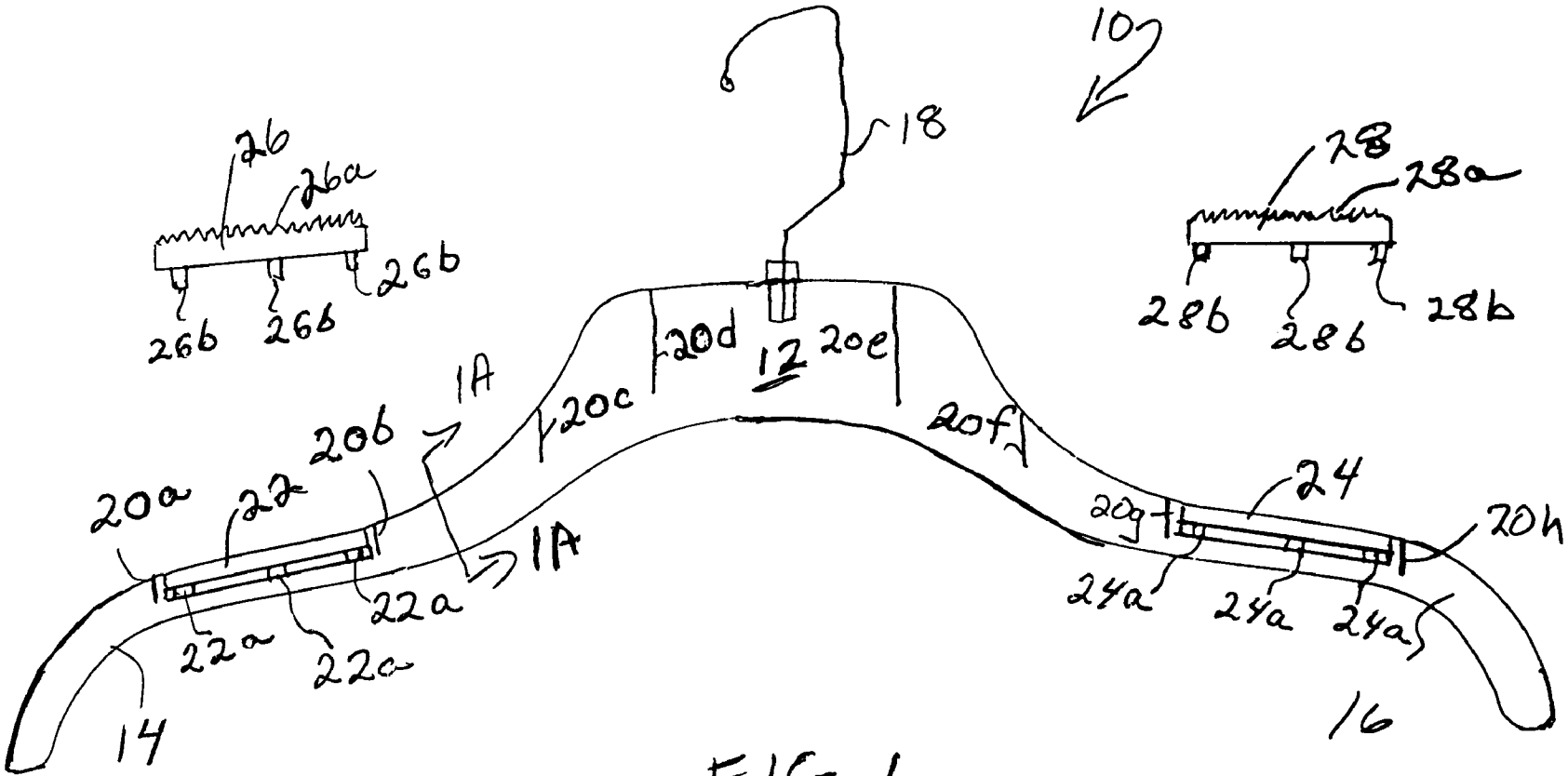
FIG. 1 is a partially exploded side elevation view illustrating a hanger according to the invention with inserts removed.
Figure 1A:
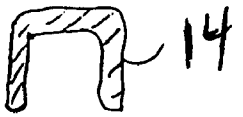
FIG. 1A is a sectional view taken along line 1A-1A in FIG. 1.

Turning now to FIGS. 1-4, a hanger 10 according to the invention has a central neck 12 with a pair of opposite sideward and downward extending shoulders 14, 16. A central hook 18 extends upward from the center of the neck 12. Although the hanger 10 may be made of any number of materials, in the illustrated embodiment, the neck and shoulders are made of a single piece of injection molded plastic such as polypropylene, polystyrene, SBC copolymers, etc. and the hook is made of metal such as steel or of the same material as the body. As seen in FIG. 1A, the illustrated embodiment has a hollow substantially (inverted) U-shape so that it possesses a certain thickness without unnecessary weight or expense of additional plastic. To provide the hollow hanger with additional durability, a plurality of reinforcing ribs 20*a*-20*h* are formed in the interior during molding.

Figure 2:
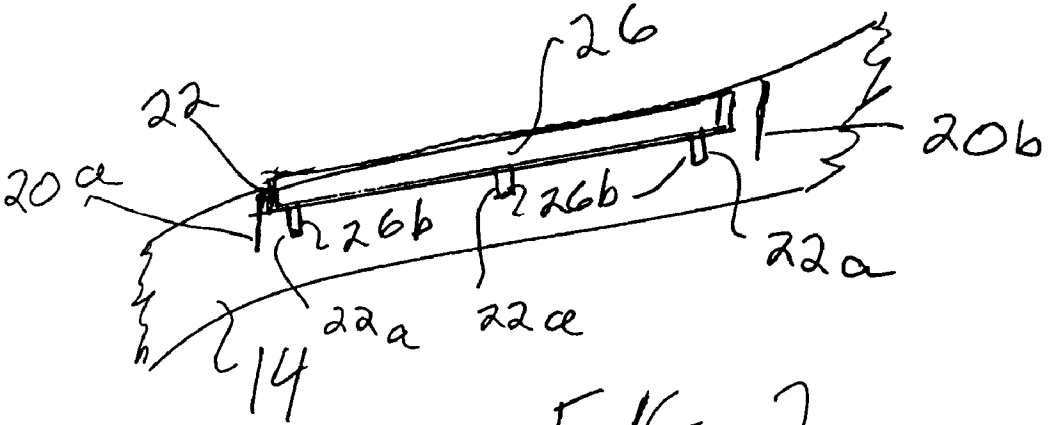
FIG. 2 is a broken enlarged side elevation view of a portion of the hanger of FIG. 1 showing an insert in place.
Figure 4:
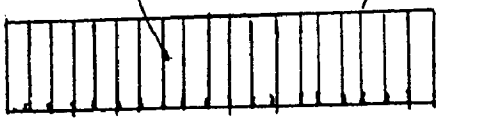
FIG. 4 is an enlarged top view of the insert.
Figure 5:
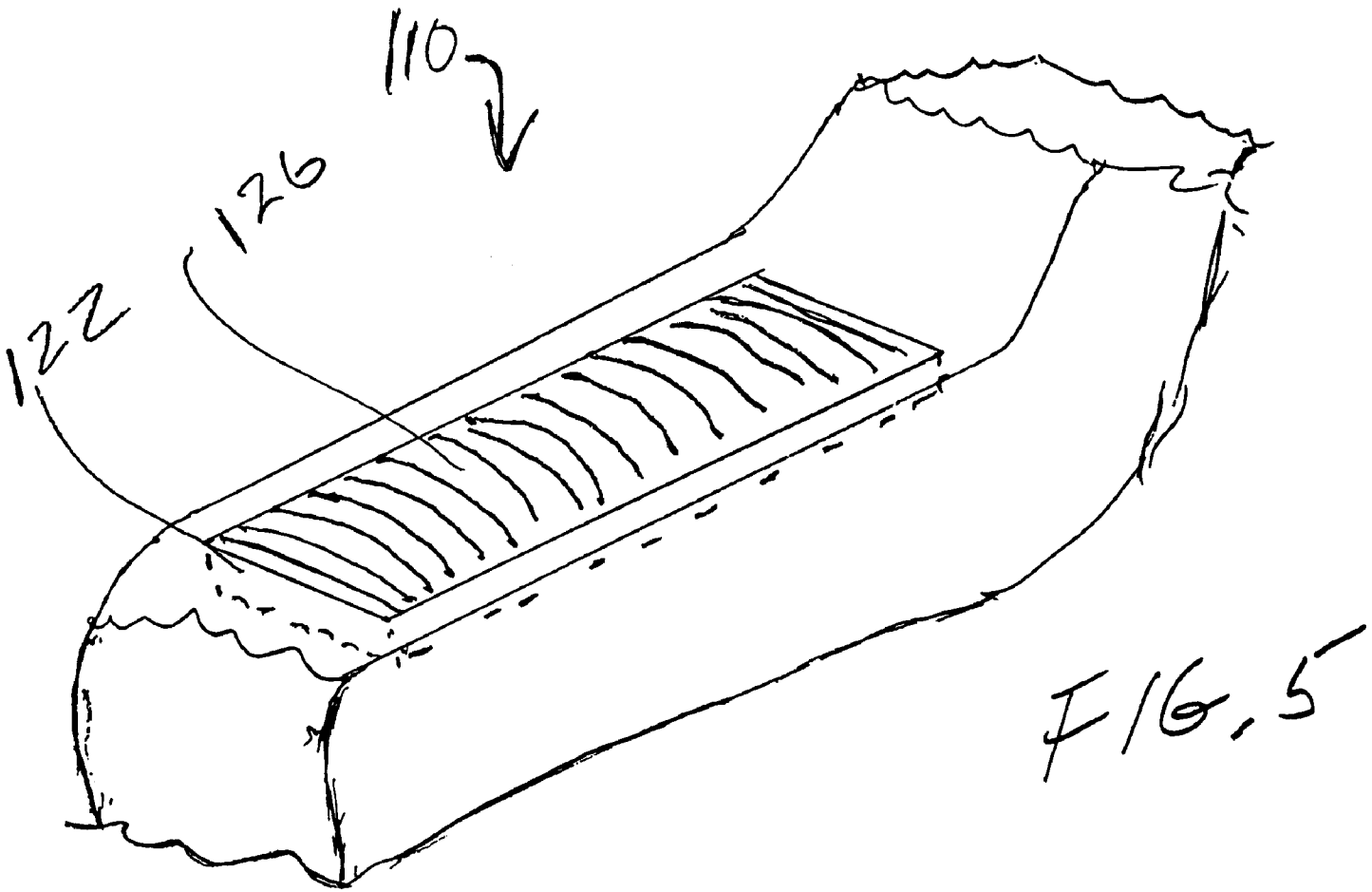
FIG. 5 is a broken perspective view showing a tapered insert in a hanger according to the invention.

According to the illustrated embodiment, the shoulders 14, 16 of the hanger 10 are each provided with a recess 22, 24 in their upper surfaces and a pair of inserts 26, 28 are disposed in the recesses. The inserts are made of a flexible plastic such as polyethylene or TPE having a higher coefficient of friction than the plastic from which the hanger shoulders are formed. As shown in FIGS. 1 and 4, the inserts are formed with upper surfaces having optional ribs 26*a*, 28*a*. The recesses 22, 24 and the inserts 26, 28 are dimensioned relative to each other so that the inserts fit snugly within the recesses as seen in FIGS. 2 and 5. In particular, the thickness of the inserts is preferably substantially equal to the depth of the recesses so that at most, the ribs (or a portion thereof) extend above the surface of the shoulders; and the width and length of the inserts are preferably substantially equal to the width and length of the recesses such that the sides of the inserts contact the recess walls. In this manner, there is no room for a finger purchase to remove the inserts from the hanger.

Figure 3:
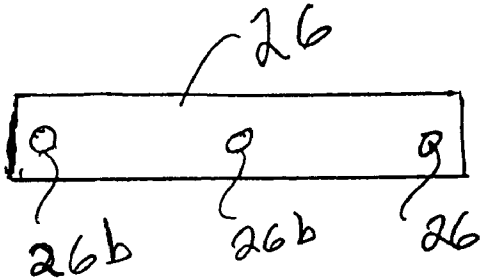
FIG. 3 is an enlarged bottom view of an insert.

In accord with a preferred aspect of the invention, the lower surfaces of the inserts 26, 28 are provided with a plurality of downward extending nubs 26*b*, 28*b* (as shown in FIGS. 1 and 3). Furthermore, as seen best in FIGS. 1 and 2, the recesses 22, 24 are provided with a plurality of throughbores 22*a*, 24*a* which correspond in number and location to the nubs 26*b*, 28*b* on the inserts 26, 28. The diameters of the nubs 26*b*, 28*b* and the throughbores 22*a*, 24*a* are dimensioned relative to each other such that the nubs frictionally engage the throughbores thereby further securing the inserts within the recesses without the need for cement, adhesives, solvents, or welding.

According to an alternate embodiment of the hanger which is illustrated in part as 110 in FIG. 5, the inserts, e.g. 126 and/or the recess 122 is/are tapered so that the center portion of the insert (i.e., along the longitudinal center line) is elevated relative to the perimeter of the insert which is substantially flush with the perimeter of the recess. Thus, the inserts generally provide a rounded, ribbed surface for the hanger arms which may be rounded as well, if desired.

The hanger and the inserts are easily made by injection molding and are quickly assembled by simply pressing the inserts into the recesses and the nubs into the throughbores. The invention eliminates the tedious manipulations required to manufacture the prior art anti-slip hangers and eliminates the need for glue or welding equipment. It also allows for relatively automated manufacture.

There have been described and illustrated herein several embodiments of an anti-slip garment hanger. While particular embodiments of the invention have been described, it is not intended that the invention be limited thereto, as it is intended that the invention be as broad in scope as the art will allow and that the specification be read likewise. Thus, while particular plastics have been disclosed, it will be appreciated that other plastics having the same or similar characteristics could be used as well. In addition, while a particular type of metal hook has been disclosed, it will be understood other metal hooks can be used or an integral plastic hook could be used. Also, while the ribbed upper surfaces of the inserts has been shown as consisting of parallel ridges, it will be recognized that other patterns may achieve the same results. Furthermore, while the inserts have been shown with three nubs and the recesses with three throughbores, it will be understood that different numbers of nubs and throughbores can be similarly used. Moreover, while the hanger neck and shoulders have been shown in a hollow U-shaped configuration, it will be appreciated that other configurations (e.g. I-beam type hangers) could be used as well. For example, the neck and shoulders could be completely solid and thus the throughbores would be bores. It will also be appreciated that the neck and shoulders of the hanger could be made of wood or another material other than plastic provided that the recesses have bores which sufficiently engage the nubs on the inserts. In addition, although the neck and hook have been shown as separate members, those skilled in the art will understand that the hook can be made an integral part of the neck. It will therefore be appreciated by those skilled in the art that yet other modifications could be made to the provided invention without deviating from its spirit and scope as claimed.

What is claimed is:

1. A method of assembling a hanger, comprising:

obtaining a hanger neck having a hook extending upward therefrom, and a pair of shoulders extending outward and downward from opposite sides of the neck, each shoulder defining a recess in an upper surface thereof, and each recess defining a plurality of bores;

obtaining a pair of inserts, each insert having a frictional upper surface which provides more friction than an upper surface of said pair of shoulders, and a plurality of nubs extending from a lower surface, said nubs being dimensioned to frictionally engage said bores in a manner which prevents the inserts from being readily movable relative to the shoulders; and pressing said inserts into respective recesses of the hanger such that each nub extends into and frictionally engages a bore and said inserts remain in said recesses without gluing or welding.

2. A method according to claim 1, wherein:

said inserts are dimensioned to fit snugly into the respective recesses, and said pressing includes causing edges of said inserts to contact walls of said recesses.

3. A method according to claim 1, wherein:

said frictional surfaces include a plurality of ridges.

4. A method according to claim 3, further comprising:

causing at least a portion of said ridges of each of said pair of inserts to extend above upper surfaces of respective shoulders of the hanger.

5. A method according to claim 4, further comprising:

causing sides of the inserts to not extend above the upper surfaces of the shoulders except for said at least a portion of the ridges.

6. A method according to claim 1, wherein:

said inserts are made from a first plastic, said pair of shoulders are made from a second plastic, and said first plastic is softer than said second plastic.

7. A method according to claim 1, wherein:

said shoulders are hollow having a substantially inverted U-shape.

8. An anti-slip garment hanger, comprising:

a neck having a hook extending upward therefrom; a pair of shoulders extending outward and downward from opposite sides of the neck, each shoulder defining a recess in an upper surface thereof, and each recess defining a plurality of bores; and a pair of inserts, each insert having a frictional upper surface which provides more friction than an upper surface of said pair of shoulders, and a plurality of nubs extending from a lower surface, said nubs being dimensioned to frictionally engage said bores in a manner which prevents the inserts from being readily movable relative to the shoulders, wherein said recesses and/or said inserts are tapered such that when said inserts are installed in said recesses, a central portion of each insert is elevated relative to a peripheral portion of the insert, the peripheral portion of the insert being substantially flush with the periphery of the recess.

9. A hanger according to claim 8, wherein:

said inserts are made from a first plastic, said pair of shoulders are made from a second plastic, and said first plastic is softer than said second plastic.

10. A hanger according to claim 8, wherein:

said plurality of bores is a plurality of throughbores and said at least one nub is a corresponding plurality of nubs.

11. A hanger according to claim 8, wherein:

said shoulders are hollow having a substantially inverted U-shape.

12. An anti-slip garment hanger, comprising:

a neck having a hook extending upward therefrom; a pair of shoulders extending outward and downward from opposite sides of the neck, each shoulder defining a recess in an upper surface thereof, and each recess defining a plurality of bores; and a pair of inserts, each insert having a frictional upper surface which provides more friction than an upper surface of said pair of shoulders, and a plurality of nubs extending from a lower surface, said nubs being dimensioned to frictionally engage said bores in a manner which prevents the inserts from being readily movable relative to the shoulders, wherein each insert is dimensioned to fit snugly into a respective recess, said frictional surfaces are formed with a plurality of ridges wherein at least a portion of said ridges of each of said pair of inserts extends above said upper surface of a respective said shoulder, said inserts have sides which do not extend above said upper surfaces of said shoulders, except for said at least a portion of said ridges.

13. A hanger according to claim 12, wherein:

each said insert fit into said respective recess in a manner which prevents a finger purchase of said insert.

* * * * *